US005883328A

United States Patent [19]

A'Costa

[11] Patent Number: 5,883,328

[45] **Date of Patent: *Mar. 16, 1999**

[54] TACTICAL SMOOTHBORE BREACHING DEVICE/FLASH SUPPRESSOR

[76] Inventor: Anthony A'Costa, P.O. Box 5806, Pueblo, Colo. 81002

[ * ] Notice: This patent issued on a continued prosecution application filed under 37 CFR 1.53(d), and is subject to the twenty year patent term provisions of 35 U.S.C. 154(a)(2).

The terminal 4 months of this patent has been disclaimed.

[21] Appl. No.: 104,452

[22] Filed: Aug. 10, 1993

[51] Int. Cl.[6] ..... F41C 21/18

[52] U.S. Cl. ..... 89/14.2

[58] Field of Search ..... 42/1.12, 79, 90, 42/106; 89/1.14, 14.05, 14.2–14.4

[56] References Cited

U.S. PATENT DOCUMENTS

| | | | |
|---|---|---|---|
| 2,166,041 | 7/1939 | Cox | 89/1.14 |
| 2,870,679 | 1/1959 | Collins | 89/14.2 |
| 2,900,875 | 8/1959 | Fergus et al. | 89/14.3 |
| 3,226,871 | 1/1966 | Sargeant | 42/79 |
| 4,024,791 | 5/1977 | Stratman | 89/14.2 |
| 4,570,529 | 2/1986 | A'Costa | 89/14.2 |
| 4,664,014 | 5/1987 | Hawley et al. | 89/14.2 |
| 5,005,463 | 4/1991 | A'Costa | 89/14.2 |
| 5,196,647 | 3/1993 | Majors | 89/1.14 |

FOREIGN PATENT DOCUMENTS

| | | | |
|---|---|---|---|
| 997788 | 9/1951 | France | 42/79 |
| 6820 | 11/1898 | Norway | 42/1.12 |
| 13621 | 9/1915 | United Kingdom | 42/90 |
| 2083894 | 3/1982 | United Kingdom | 89/14.3 |

OTHER PUBLICATIONS

Holler, Walker W., Glossary of Ordnance Terms, "Shotgun", p. 260, Jun. 1959.

*Primary Examiner*—Charles T. Jordan
*Assistant Examiner*—M. J. Lattig
*Attorney, Agent, or Firm*—Richard W. Hanes

[57] ABSTRACT

A combined tactical breaching device and flash suppressor comprising a cylindrical body portion having a longitudinal central smoothbore, the body portion being threaded at one end thereof for threadedly engaging the muzzle of a firearm barrel, a pair of longitudinally extending diametrically opposed furcations formed in the other end of the body portion by a pair of diametrically opposed slots formed in the body portion and extending from the other end toward the first end, the slots being of a length and width such that when the other end is placed against a target and in contact therewith, frangible ammunition may be discharged through said device for breaching the target; also disclosed is a method for breeching a barrier such as a door, dead bolt locks and 1/4 inch steel plate, where applicable.

1 Claim, 2 Drawing Sheets

TACTICAL SMOOTHBORE BREACHING DEVICE/FLASH SUPPRESSOR

This invention relates to a tactical breaching device for use by police tactical teams. More particularly this invention relates to an improved tactical device for use with shotguns for assisting with forced entry into structures such as doors, windows, gates and the like.

BACKGROUND AND OBJECTS OF THE INVENTION

Many devices have been developed for use by tactical teams of police departments, for aiding police officers in certain situations. A number of such devices have been developed to aid the officers in gaining entry into buildings and other structures and particularly occupied buildings. In recent years, a great need has developed for devices which would enable rapid breaching of doors, gates and similar barriers.

While many devices have been developed for these purposes, they have met with varying degrees of success for a variety of reasons. For example, while some devices will satisfactorily function to breach a door, they are more in the nature of hand tools meaning that they take longer to operate. The longer that the device takes to breach the door, the greater is the risk to the officers involved.

Other devices are more in the nature of explosive type devices which function by an explosive charge to destroy a lock, a hinge, or both. Again, while such devices operate more quickly, the explosive type of device can pose a risk to both the officers using the device and to the occupants of the structure. For example, an explosive charge can injure anyone close to the charge when it is detonated. Similarly, the use of shotguns is possible for breaching a hinge, a lock, or the like, but this also poses a great risk to occupants of the structure.

More recently, special ammunition has been developed for breaching such structures. Such ammunition is available under the trademarks "SHOK LOCK" or "AVON" and is designed with a frangible "projectile" which disintegrates on impact, but which imparts a great amount of force to the target upon disintegration. The ammunition is typically designed for use with shotguns, and in general the "projectile" comprises a mixture of a material such as dental plaster mixed with metal powder which is molded to the shape of a projectile and placed into a shotgun shell.

In use, the ammunition is loaded into the gun, aimed at the target, and is discharged. The force of the "projectile" is intended to breach a hinge, lock, etc. and to disintegrate while imparting the force to the target. In this manner, only a small amount of debris, primarily dust, enters the structure, while the door, lock, gate, etc. is essentially destroyed.

Such ammunition is, however, somewhat unreliable in many applications, and is not always consistent in function. For example, the distance between the muzzle of the shotgun and the target can make a great difference in the breaching force created when the weapon is discharged, as can the angle of impact. A ninety degree angle of incidence usually creates a greater amount of force than any lesser angle.

In the past, applicant developed an improved flash suppressor which relied upon smoothbore technology to provide significant benefits to the flash suppressor. This technology is described in applicant's prior U.S. Pat. No. 4,570,529 dated Feb. 18, 1986. The present invention relies upon the technology described in that patent, the specification of which is incorporated herein by reference.

Thus, a primary object of the present invention is to provide a device for use with frangible ammunition for improving the reliability thereof in tactical use.

Another object of the invention is to provide a device for use with shotguns using frangible ammunition for improving the safety of the ammunition to the user and others nearby.

A further object of the invention is to provide an attachment for shotguns which greatly improves the usefulness of the frangible ammunition in tactical situations.

Still another object of the present invention is to provide an attachment for firearms which uses the technology of smoothbore barrels and provides a dual function of inhibiting flash from the muzzle and enabling the use of the firearm for repeated discharge of frangible ammunition with greatly improved reliability.

Yet another object of the invention is to provide a flash suppressor for firearms, including shotguns and rifled barrel weapons, and which enables the muzzle end of the firearm to be placed against a target and, using frangible ammunition, to breach a door, lock, gate, or similar such barrier with greatly enhanced reliability and safety to all persons in the vicinity.

Still a further object of the invention is to provide an attachment for firearm barrels, such as rifles and shotguns, which increases the muzzle velocity of the projectile, and therefor the force imparted by the projectile.

DESCRIPTION OF THE INVENTION

The tactical breaching device and flash suppressor according to the present invention comprises a cylindrical body portion having a longitudinal central bore which may be threaded at one end for attachment to the muzzle end of a firearm barrel, or which could also be welded thereto. The central portion of the body comprises a longitudinal smoothbore therethrough, and extending from the smoothbore portion are a pair of integral diametrically opposed furcations which are separated by a pair of diametrically opposed slots extending from the body portion and open at the distal end.

The slots (and thus the furcations) are of such a length and width that when the distal end of the device is placed against a target and in contact with the target that frangible ammunition may be discharged through the device for breaching the target, without damage to the firearm, the user or others nearby.

In a preferred embodiment for use with 12 gauge shotguns, the furcations have a length of about 2 inches although for different caliber weapons, different lengths would need to be used.

DESCRIPTION OF THE DRAWINGS

The foregoing and other objects and advantages of this invention will become apparent from a consideration of the following specification and claims, when taken together with the accompanying drawings, in which:

DETAILED DESCRIPTION OF PREFERRED EMBODIMENTS

Figure 1:
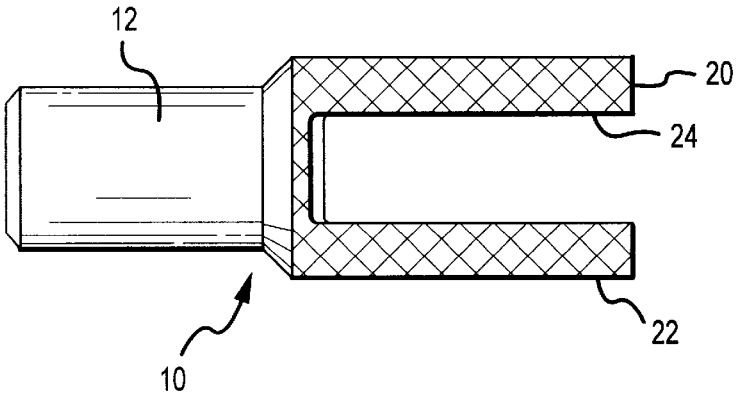
FIG. 1 is a side elevational view of a flash suppressor according to the present invention for use with a shotgun.
Figure 2:
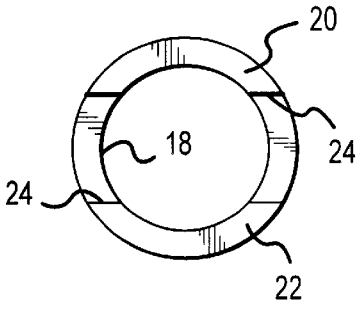
FIG. 2 is an end view thereof.
Figure 3:
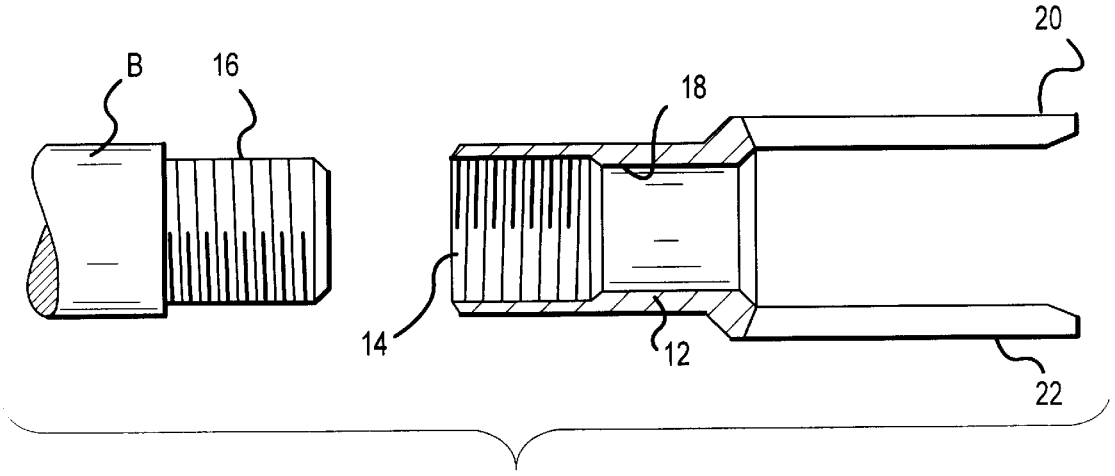
FIG. 3 is a view showing the device of FIG. 1 is longitudinal cross-section in position for attachment to the barrel of a shotgun.

The embodiment of the invention shown in FIGS. 1 through 3 is intended for use on shotguns, an in particular 12 gauge shotguns as are commonly used by many tactical teams. The device generally designated 10 includes a cylindrical body portion 12 which has an internally threaded portion 14 at one end thereof.

The flash suppressor 10 is intended for use with a shotgun barrel B which has been modified so as to be provided with external threads 16, such that the threaded portion 14 will threadedly engage the barrel B.

The body 12 of the flash suppressor has an internal smoothbore 18 which is slightly greater in inside diameter than the bore of the shotgun barrel B. For a 12 gauge shotgun, the bore 18 is 0.785 inch, such that the projectile does not make appreciable contact with the walls of the bore 18. Rather, the smoothbore portion allows full combustion of the gases and powder from the ammunition.

Extending from the body portion 12 of the flash suppressor are a pair of diametrically opposed furcations 20, 22. The furcations 20 and 22 are separated by slots 24 which extend from the body portion 12 to the end of the flash suppressor. These slots are therefor open at one end. The length of the slots (and the furcations) is approximately 2 inches in the embodiment shown, which would be appropriate for all shotguns.

In use, the device is attached to the muzzle of the barrel B by threading the threaded portion 14 of the suppressor onto the threaded portion 16 of the barrel. Alternatively, the threads could be eliminated and the device could be welded in place on the barrel.

Tests have shown this device to be highly effective as a flash suppressor, eliminating substantially all flash visible to the naked eye. Typically, a shotgun has a blinding flash produced during firing at night, making it difficult for the shooter to recover for a second shot. Indeed, such flash is usually far greater than is produced by a pistol or rifle. By contrast, with the device of FIGS. 1–3 attached to the shotgun, the shooter has far quicker recovery.

When used with frangible ammunition, the muzzle of the shotgun, i.e. the end of the flash suppressor, is placed directly against the target, in contact therewith. For example, a door lock, a door hinge, or the like are typical targets, and the barrel with the flash suppressor is placed against this target, with the barrel at a right angle to the target. When the shotgun is fired, the frangible projectile impacts the target with enough force and velocity to dislodge hinges, dead bolt locks, etc., enabling quick entry into a structure.

The slots 24 of the device enable the release of the gasses and debris from the round, and the dust from the projectile is dissipated with but minimal blowback toward the shooter. Similarly, only minimal damage and penetration within the barrier is produced.

The device also has been found to greatly reduce the recoil of the firearm considerably, thereby providing better control of the weapon.

The device does not interfere with conventional use of the shotgun during daytime shooting, or shooting with conventional ammunition. However, the device does still provide reduced recoil and greater muzzle velocity for such conventional ammunition.

Figure 4:
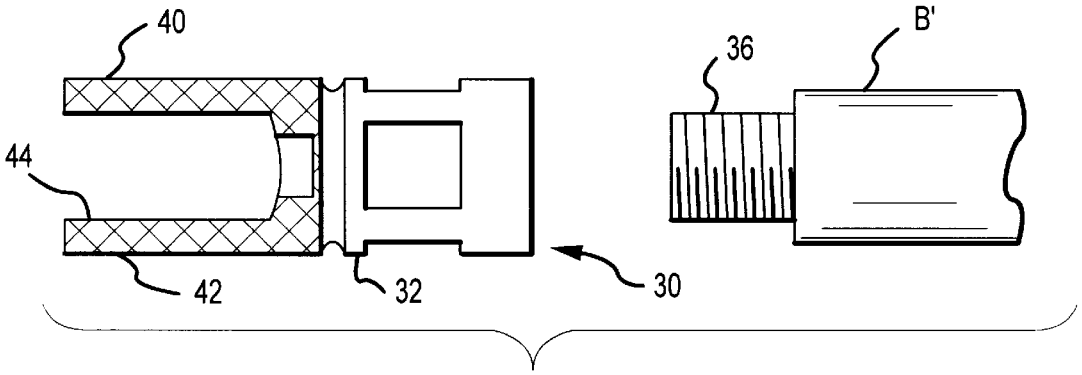
FIG. 4 is an exploded view of a similar device for use with a rifle barrel.
Figure 5:
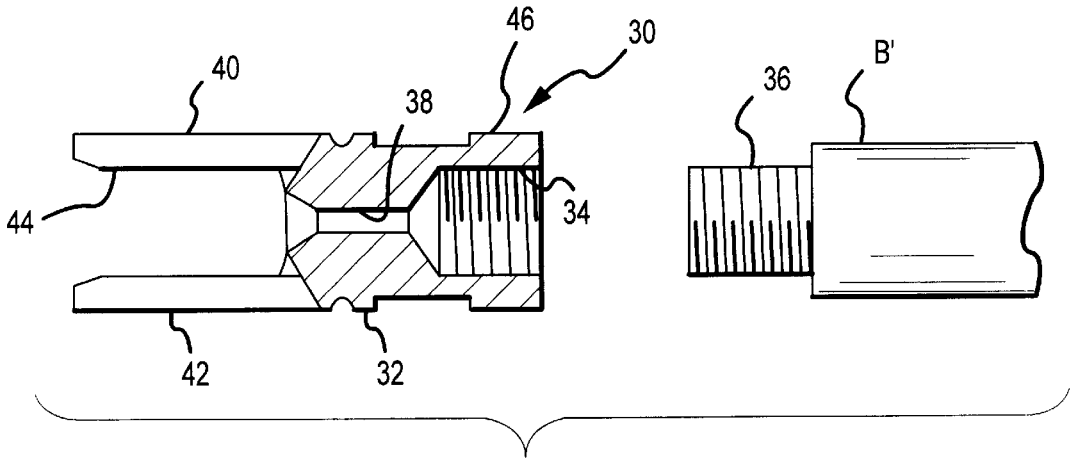
FIG. 5 is a view similar to FIG. 4 showing the device in longitudinal cross-section.

The embodiment shown in FIGS. 4 and 5 is intended for use with a rifle of any suitable caliber. Structurally, the device of this embodiment is quite similar to the first embodiment, and the suppressor 30 is seen to include a body portion 32 which is internally threaded at one end 34 for attachment to the barrel of a gun. Thus, the barrel B' has an externally threaded portion 36 which threads into the portion 34 of the flash suppressor 30. An internal smoothbore 38 in the body portion 32 is sized according to the caliber of the particular rifle. Preferably, this smoothbore portion is sized according to the technology disclosed in prior U.S. Pat. No. 4,570,529.

At the end of the bore 38, a conical flaring of the bore 38 is provided to facilitate expansion of the gases from the ignition of the powder.

A pair of furcations 40, 42 extend from the body portion 32 and are separated by slots 44. Flats 46 may be provided on the outside of the body 32, to assist in tightening the body portion onto the barrel B'.

This flash suppressor has been found to reduce or eliminate flash from conventional rifles of small or large calibers, just as the previous embodiment was able to eliminate flash from large caliber weapons such as shotguns. So far as known, no flash suppressor is available for shotguns, because of the nature of the ammunition, the quantity of unburned powder giving rise to a very large flash, and the need to avoid devices which would reduce the already low accuracy of shotguns.

Thus, the present invention may be applied to both shotguns and rifles and will provide significant flash reduction or elimination for each. In addition, when used with shotguns, the device facilitates the use of frangible ammunition for barrier breaching uses, providing unequalled reliability, due to the ease of repetitive use of the device.

While this invention has been described as having certain preferred features and embodiments, it will be understood that it is capable of still further variation and modification without departing from the spirit of the invention, and this application is intended to cover any and all variations, modifications and adaptations of the invention as fall within the spirit of the invention and the scope of the appended claims.

I claim:

1. A breaching device for attachment to an externally threaded end of a firearm barrel, the breaching device comprising:

A cylindrical walled body having a stepped diameter cylindrical bore therethrough, wherein a lesser diameter bore is formed at a first end of the body and a greater diameter bore is formed at a second end of the body and wherein a portion of the lesser diameter bore is threaded and is sized and configured to be removably mated to the external threads on the end of a firearm barrel;

A truncated conical section interconnecting the lesser diameter bore and the greater diameter bore; and Two opposed, elongated and parallel sided vents disposed in the walls of the second end of the cylindrical body.

* * * * *